US005947875A

United States Patent [19]

Cone et al.

[11] Patent Number: 5,947,875

[45] Date of Patent: Sep. 7, 1999

[54] TODDLER EXERCISER

[75] Inventors: Richard E. Cone, Athens, Ohio; Michael S. Rosko, Greenwood, Ind.

[73] Assignee: Cosco, Inc., Columbus, Ind.

[21] Appl. No.: 08/556,116

[22] Filed: Nov. 9, 1995

[51] Int. Cl.[6] ..... A63B 22/00

[52] U.S. Cl. ..... 482/69; 482/904; 482/143

[58] Field of Search ..... 482/69, 126, 904, 482/143; 297/274, 275; 269/97, 156; D6/333; D8/72, 73

[56] References Cited

U.S. PATENT DOCUMENTS

| | | | |
|---|---|---|---|
| 279,432 | 6/1883 | Raymond . | |
| D. 302,360 | 7/1989 | Riehm . | |
| D. 305,722 | 1/1990 | Riehm . | |
| D. 336,994 | 7/1993 | Mitchell et al. | D6/333 |
| 339,650 | 4/1886 | Hill | 482/69 |
| D. 355,533 | 2/1995 | Meeker . | |
| D. 360,905 | 8/1995 | Meeker et al. . | |
| 401,266 | 4/1889 | Gray . | |
| 472,351 | 4/1892 | Higham . | |
| 483,270 | 9/1892 | Tothill . | |
| 838,072 | 12/1906 | Benner . | |
| 1,055,975 | 3/1913 | Hawk . | |
| 1,057,360 | 3/1913 | Patten . | |
| 1,104,609 | 7/1914 | Blain . | |
| 1,126,291 | 1/1915 | Rundle . | |
| 1,629,676 | 5/1927 | Buckminster . | |
| 1,757,423 | 5/1930 | Gerrond . | |
| 2,080,795 | 5/1937 | Stone . | |
| 2,408,002 | 9/1946 | Shurtliff . | |
| 2,645,271 | 7/1953 | Call et al. . | |
| 2,655,198 | 10/1953 | Williams et al. . | |
| 2,912,044 | 11/1959 | Giffen . | |
| 2,967,566 | 1/1961 | Bieda . | |
| 3,019,053 | 1/1962 | Lambert . | |
| 3,314,636 | 4/1967 | McHugh . | |
| 3,401,978 | 9/1968 | Wrigglesworth . | |
| 4,410,175 | 10/1983 | Shamp | 482/69 |
| 4,733,861 | 3/1988 | Plunket, III | 482/126 |
| 4,877,238 | 10/1989 | Barrett . | |
| 4,948,117 | 8/1990 | Burke | 482/129 |
| 5,240,460 | 8/1993 | Tighe . | |
| 5,288,283 | 2/1994 | Meeker . | |
| 5,403,270 | 4/1995 | Schipper . | |
| 5,429,571 | 7/1995 | Smith et al. | 482/904 |

OTHER PUBLICATIONS

Malbly & Sons Photo litho, 1894.

*Primary Examiner*—Jerome W. Donnelly
*Attorney, Agent, or Firm*—Barnes & Thornburg

[57] ABSTRACT

A doorway exerciser is provided for exercising a child positioned therein. The doorway exerciser includes a mounting assembly, a lower hanger, a shock cord, and a seat unit. The mounting assembly is adapted for removable attachment with a doorway framework and is formed to include a passageway therein. The lower hanger is formed to include a passageway therein. The shock cord has opposite ends and an extensible center portion extending between the opposite ends. One end of the cord extends in the passageway of the mounting assembly. An opposite second end of each cord extends in the passageway of the lower hanger so that the lower hanger is suspended from the mounting assembly. The seat unit is suspended from the lower hanger. The mounting assembly has a first clamp member including a catch and a core and an opposing second clamp member which includes a catch and a core. The cores of the first and second clamp members are coupled together for pivotable movement therebetween. The cores of the first and second clamp members are each formed to include a slot therethrough and the cores are positioned relative to one another such that the slots at least partially overlap one another. The mounting assembly further includes a clamp pin extending through the slots.

14 Claims, 8 Drawing Sheets

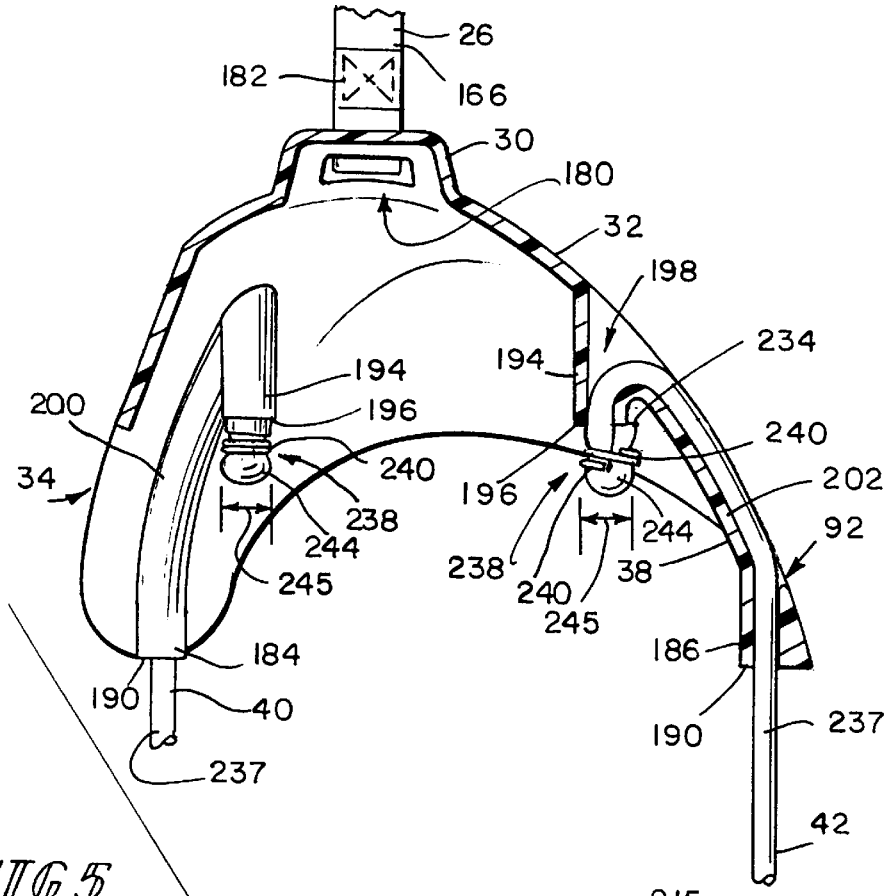
FIG. 5
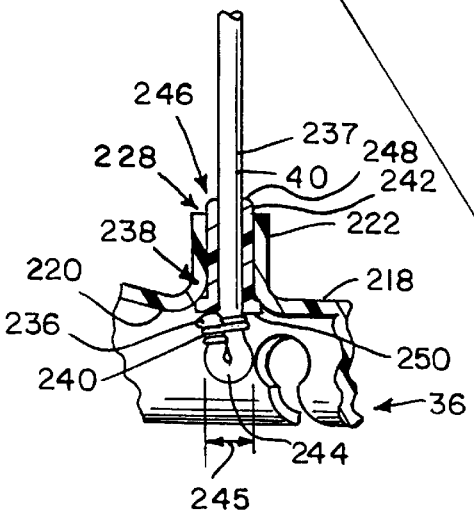
FIG. 6
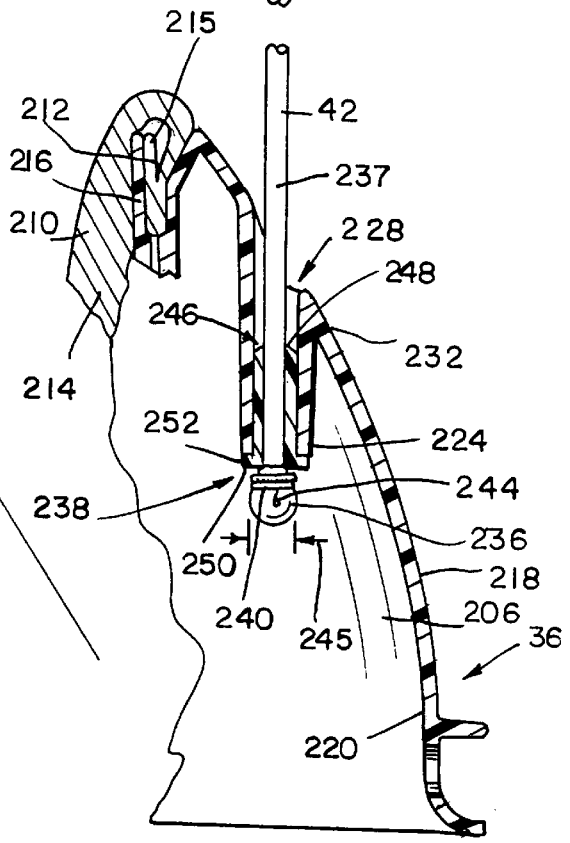

TODDLER EXERCISER

BACKGROUND AND SUMMARY OF THE INVENTION

This present invention is directed to an exerciser for small children, and particularly to an doorway exerciser for toddlers. More particularly, the present invention is directed to a doorway exerciser having a extensible shock cord mounted between a doorway clamping device and a flexible belt coupled to a seat.

Doorway exercisers, which are also known as "jumpers", typically use metal extension springs to provide perform the necessary resiliency for the jumping action. See, for example, U.S. Pat. Nos. 2,408,002 to Shurtleff and 3,314,636 to McHugh. These extension springs often include fabric cords extending through the spring. The presence of fabric cords adds expense to a typical jumper. Moreover, extension springs are typically exposed and in full view of the consumer. Therefore, to improve their general appearance, exposed springs often require expensive plating and finishes.

Manufacturers have attempted to reduce the expense attributed to these extension springs by using a compression spring housed inside of a rigid tube constructed of plastic. See, for example, U.S. Pat. Nos. 5,288,283 to Meeker; Des. 355,533 to Meeker; and Des. 360,905 to Meeker et al. Moreover, rubber members have been used to support the bouncer. See, for example, U.S. Pat. Nos. 2,912,044 to Giffen and 3,401,9778 to Wrigglesworth. Although exercisers having rubber members as well as conventional metal extension and compression springs are in widespread use, caregivers will welcome an improved doorway exerciser having an extensible shock cord which is not as heavy as metal spring, is quiet while in operation, and which sees a reduction in stress applied to the inner fibers of the cord. What is needed is a doorway exerciser for toddlers that can be mounted easily on the framework of a doorway and that includes a shock cord to provide desirable bouncing for a toddler situated within the exerciser.

According to the present invention, an attachment apparatus is provided for mounting an exerciser on a framework of a doorway. The attachment apparatus includes a mounting assembly adapted for selective attachment on the framework. A cord hanger is coupled to the mounting assembly and a shock cord, extends therefrom. In addition, a belt hanger is provided. The shock cord includes opposite ends and an extensible center portion extending between the opposite ends. One end of the cord forms a bulb which is coupled within the cord hanger and the opposite end of the cord forms a second bulb which is coupled within the belt hanger.

Preferably, the first end of the cord is folded upon the center portion in order to form a looped portion of the first bulb. An end clip extends about the looped portion to fasten the first end against the center portion. Moreover, the second end of the cord is folded upon the center portion to form a looped portion of the second bulb. A second end clip extends about the looped portion to fasten the second end against the center portion. The bulb of the first end is held within the cord hanger by a first end cap and the second end is held within the belt hanger by a second end cap.

In preferred embodiments, the attachment apparatus further includes a strap support having a belt mount attached thereto and a flexible belt that extends between the belt hanger and the belt mount of the strap support. The strap support is generally umbrella shaped in order to position mounting straps in a spaced-apart relationship relative to one another to aid in insertion of the child in the seat.

In preferred embodiments of the present invention, a doorway exerciser is provided. The exerciser includes the attachment apparatus as described above. Further, a seat is provided for attachment to the strap support. Flexible straps are fastened to the seat and terminate at their ends in loop knots which are formed for secure engagement with an inner surface of the strap support.

A child exerciser kit is provided to enable caregivers to easily choose a desired method of exercise for the small child. The kit has component parts capable of being assembled in the home or care center for providing both a doorway exerciser and a stationary floor bouncer for small children. In one embodiment, the seat is formed to include a frame having an outward side, an inward side, and an outer edge extending about the periphery of the frame between the outward and inward sides. A plurality of keyhole shaped mounting slots extend through the outer edge in order that the flexible straps may be selectively detached from the seat. Advantageously, the caregiver can detach the seat from the attachment apparatus and recouple the seat to a stationary jumper frame. For example, the kit includes a seat assembly, an attachment apparatus for connecting to a door frame or the like to suspend the seat assembly in a doorway to provide a doorway exerciser or jumper, and a stationary frame for alternatively supporting the seat assembly above an underlying surface to provide a stationary floor bouncer.

From a manufacturer's perspective, an exerciser in accordance with the present invention is preferable over traditional jumpers because the use of an extensible shock cord eliminates the need to improve the general appearance of exposed springs by expensive plating and finishes. Moreover, the extensible cord when doubled over itself into a bulb sees a reduction in the stress applied to the internal fiber of the cord. Moreover, it is believed that the individual rubber cords which make up the extensible shock cord, do not have a propensity to slip over one another as freely as when the shock cord is not formed in the bulb. This allows the shock cord to have an improved cycle life which is measured by the number of expansions and contractions of the cord. Moreover, the cord, when doubled over, prevents the clip from being pulled from the cord hanger and the belt hanger.

A user of an exerciser in accordance with the present invention will also find that the exerciser is preferable over traditional exercisers. The mounting apparatus is easily secured onto the framework of the door. Moreover, the shock cord is quiet while in operation.

Additional objects, features, and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 5 is a partial cross-sectional view of the strap support and seat of FIG. 1 showing the flexible strap terminating at its distal ends in loop knots and the ends are secured to both the seat and the strap support;

FIG. 6 is partial cross-sectional view of the seat of FIG. 1 showing the seat having a frame formed to include a strap leaders, a strap-receiving aperture therethrough, and a retaining ring extending about the strap and the strap extending through both the retaining ring and the leader and the loop knot engaging the retaining ring to securely attach the flexible strap to the seat;

DETAILED DESCRIPTION OF THE DRAWINGS

Figure 1:
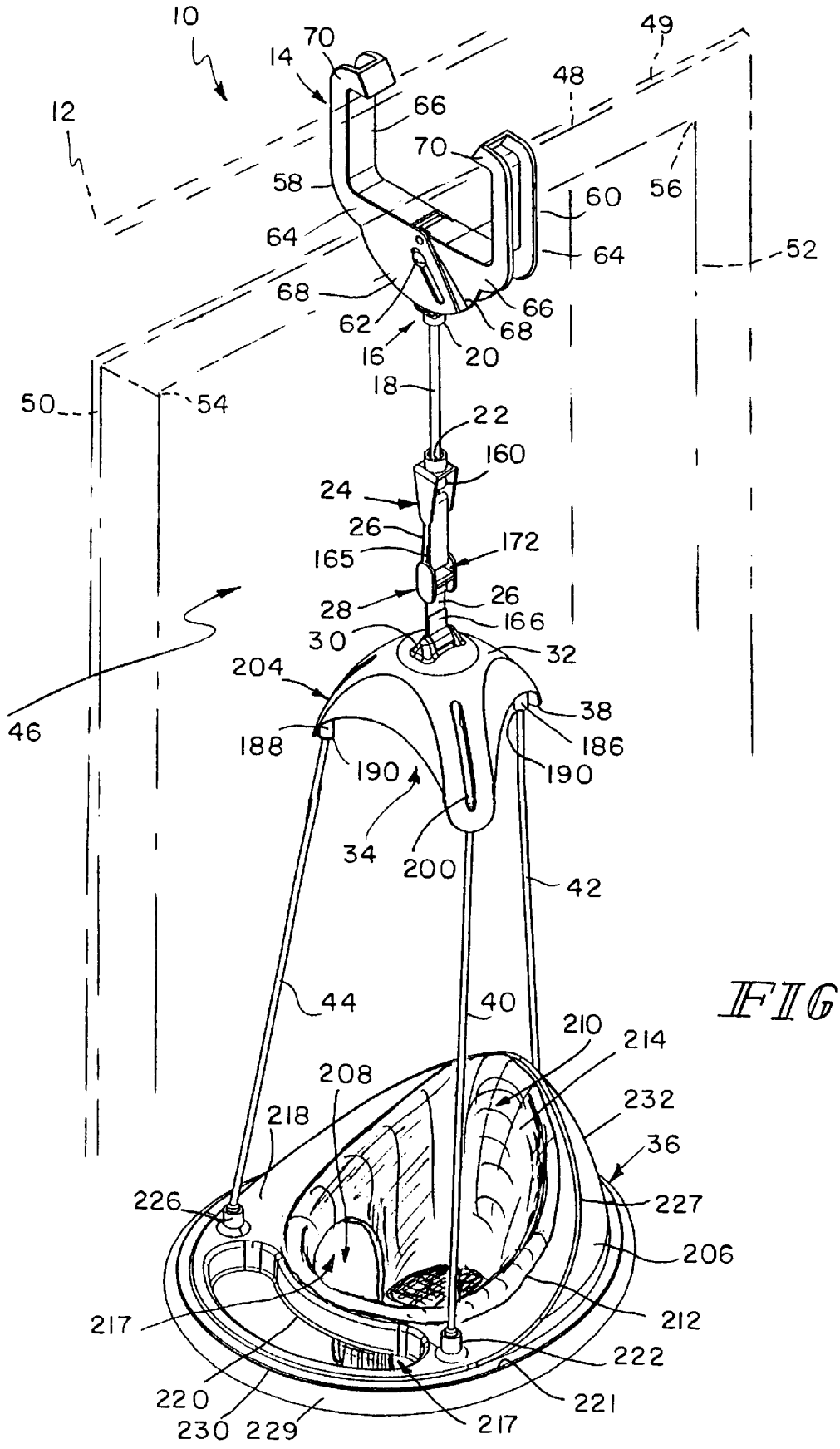
FIG. 1 is perspective view of an exerciser mounted in a doorway, the exerciser including a mounting assembly, a cord hanger coupled to the mounting assembly, a belt hanger, an extensible shock cord extending between the cord and belt hangers, a strap support having strap slots extending therethrough, an adjustable flexible belt extending between the belt hanger and the strap support, a child seat, and flexible straps extending from the seat and through the strap slots for attachment with the strap support.

A doorway exerciser apparatus 10 in accordance with the present invention is shown in FIG. 1 as it would appear to a caregiver after it has been mounted on a framework 12. The exerciser apparatus 10 includes a mounting assembly 14, a cord hanger 16 affixed in the mounting assembly 14, and an extensible shock cord 18 attached at one end 20 to the cord hanger 16. In addition, an opposite end 22 of the shock cord 18 is attached to a belt hanger 24. A flexible belt 26 extends from the belt hanger 24 and loops through both a belt adjuster 28 and a belt mount 30. Illustratively, the belt mount 30 is appended to an umbrella-shaped strap support 34. A seat, sized to support a child (not shown), is suspended from the strap support 34 by three flexible straps 40, 42, 44.

Illustratively, the exerciser apparatus 10 is formed for secure attachment to the framework 12 surrounding a doorway 46, as shown for example, in FIG. 1. Preferably, the framework 12 includes a top section 48 surrounding a structural wall 49 and a pair of side sections 50, 52 extending from opposite ends 54, 56 of the top section 48. The top section 48 is configured to receive the mounting assembly 14 thereon. Thus, the exerciser apparatus 10 is suspended within the doorway 46 and the seat 36 is positioned just above a surface (not shown) such that the child's feet will just touch the surface once placed in the seat 36.

Figure 2:
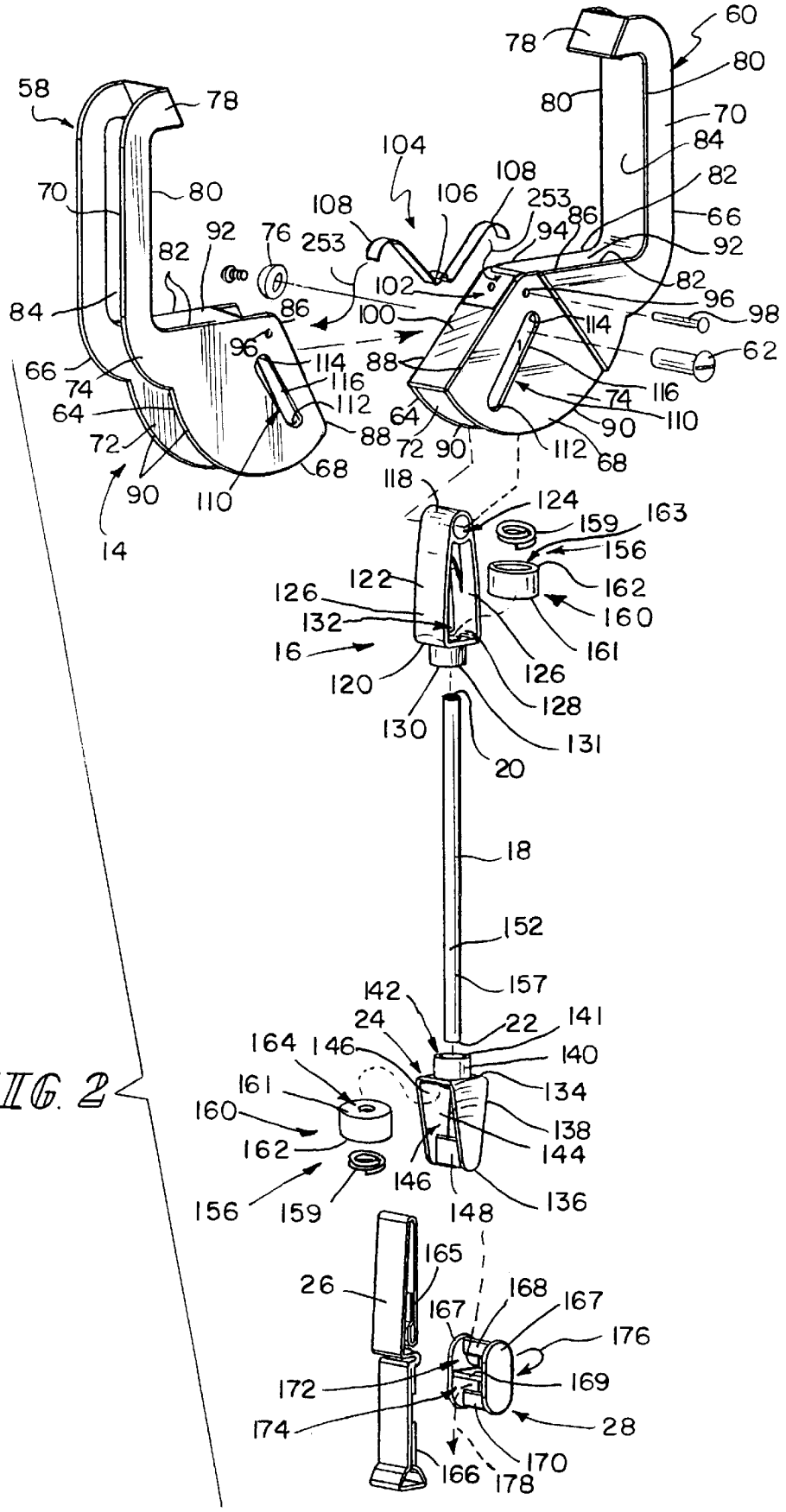
FIG. 2 is an exploded assembly view of a doorway attachment apparatus for the exerciser of FIG. 1 showing the mounting assembly having opposing clamp members, a clamp spring, and a clamp pin formed for extension between the clamp members, the cord hanger having both an opening sized for receiving the clamp pin therethrough and a housing formed to receive the first end of the extensible cord, the belt hanger having a cord passageway for receiving the second end of the belt aperture therethrough, a belt adjuster, and the flexible belt being formed for extension through the belt adjuster.

The mounting assembly 14 of the exerciser apparatus 10 includes a first clamp member 58, second clamp member 60, and a clamp pin 62 extending between the first and second clamp members 58, 60. Referring to FIG. 1, the first and second clamp members 58, 60 each include a first side wall 64 and an opposite second side wall 66. The side walls 64, 66 cooperate to form a core portion 68 and a catch portion 70 extending outwardly from the core portion 68. As shown in FIG. 2, the first and second side walls 64, 66 further cooperate to form a pair of inside faces 72 and opposite outside faces 74.

Moreover, in order to grip the framework 12, the catch portions 70 of the first and second clamp members 58, 60 face one another in an opposing arrangement. Illustratively, the opposing arrangement of the members 58, 60 causes the first side wall 64 of clamp member 58 to become aligned with the second side wall 66 of clamp member 60 as shown, for example, in FIG. 2. Thus, when the mounting assembly is affixed to the framework 12, as shown, for example, in FIG. 1, the inside faces 72 of the first clamp member 58 are positioned adjacent to the outside faces 74 of the second clamp member 60. The clamp pin 62 is fastened to opposing clamp members 58, 60 by a clamp washer 76.

The catches 70 of the clamp members 58, 60 are generally C-shaped and have an upper tab 79 formed for engagement with the framework 12 of the doorway 46, side edges 80 extending from the upper tab 78 towards the core 68, and lower edges 82 facing the upper tab 78. Illustratively, the lower edges 82 extend from the side edges 80, over the respective cores 68, and terminate at a pivot edge 86. Preferably, a side platform 84 extends between the side edges 80 and a top platform 92 extends between the lower edges 82 to add stability to the side walls 64, 66. As best shown in FIG. 2, to permit yieldable pivoting of the first and second clamp members 58, 60, the top platform 92 of the first clamp member 58 fails to extend to the pivot edge 86. The second clamp member 60, however, includes an indented portion 94 positioned between the inside faces 72 of the side walls 64, 66 and extending to the pivot edge 86.

The cores 68 of the respective clamp members 58, 60 are generally pie-shaped and positioned in a spaced-apart relationship relative to the upper tab 78 of the catch 70. The side walls 64, 66 that form the respective cores 68 include outer edges 88 slanting downwardly from the pivot edge and away from the side edges 80. In addition, the side walls 64, 66 have curved edges 90 that extend upwardly from the outer edges 88 and back toward the lower edges 82 and the respective catches 70.

Rivet apertures 96 extend through the core 68 of each of the clamp members 58, 60. As best shown in FIG. 2, a rivet 98 is formed for extension through the rivet aperture 96 and thus through both of the first and second side walls 64, 66. Preferably, the second clamp member 60 has an outer side platform 100 extending between the outer edges 88 of the first and second side walls 64, 66. A spring entrance 102 extends through the side platform 100 and is sized to receive a clamp spring 104 therein. Illustratively, the clamp spring 104 includes a curved center portion 106 formed to rest upon the rivet 98 and outwardly extending arm portions 108.

Continuing to refer to FIG. 2, each core 68 is formed to include a slot 110 extending generally parallel to the outer edges 88 of the side walls 64, 66. Each slot 110 includes a lower end 112 adjacent the curved edges 90, an opposite upper end 114 adjacent the pivot edge 86, and a central wedge portion 116 positioned therebetween. Illustratively, each slot 110 is sized for sliding movement of the clamp pin 62 between the lower end 112 and the upper end 114.

The cord hanger 16 is formed to be mounted on the clamp pin 62 and to be situated within the mounting assembly 14 between the inside faces 72 of the second clamp member 60. The cord hanger 16 itself includes a top end portion 118 adjacent the mounting assembly 14, an opposite bottom end portion 120, and a middle portion 122 extending therebetween as shown, for example, in FIG. 2. An aperture 124, sized for extension of the clamp pin 62 therethrough, extends through the top end portion 118 so that the top end 118 of the cord hanger 16 may be pivotably mounted within the mounting assembly 14. The middle portion 122 of the cord hanger 16 includes opposite border walls 126 which define a hollow central cavity 128 sized to receive at least a portion of the extensible cord 18 therein. In addition, the bottom end 120 of the cord hanger 16 is formed to include a cylindrical housing 130 extending outwardly therefrom. The housing 130 includes a mouth 131 defining a passageway 132, sized to receive the cord 18. The mouth has a diameter 133 and the passageway 132 extends through the cylindrical housing 130. It is understood that the border walls 126 may take on a variety of forms so long as the central cavity 128 is sized to receive at least a portion of the cord 18 therein.

The belt hanger 24 includes a head portion 134, an opposite tail portion 136, and a body portion 138 extending between the head and tail portions 134, 136. The head portion 134 is formed to include a cylindrical casing 140. The casing 140 includes a lip 141 defining a cord passageway 142 sized to receive the shock cord 18 therein. The lip 141 has a diameter 143 and the cord passageway 142 extends through the casing 140 as shown, for example, in FIG. 2. The body portion 138 of the belt hanger 24 is formed to include opposite border walls 144 that define a hollow space 146 which is sized to receive at least a portion of the cord 18 as well as at least a portion of the flexible belt 26 therein. In addition, a slat 148 extends through the hollow space 146 between the opposite border walls 144.

Figure 3:
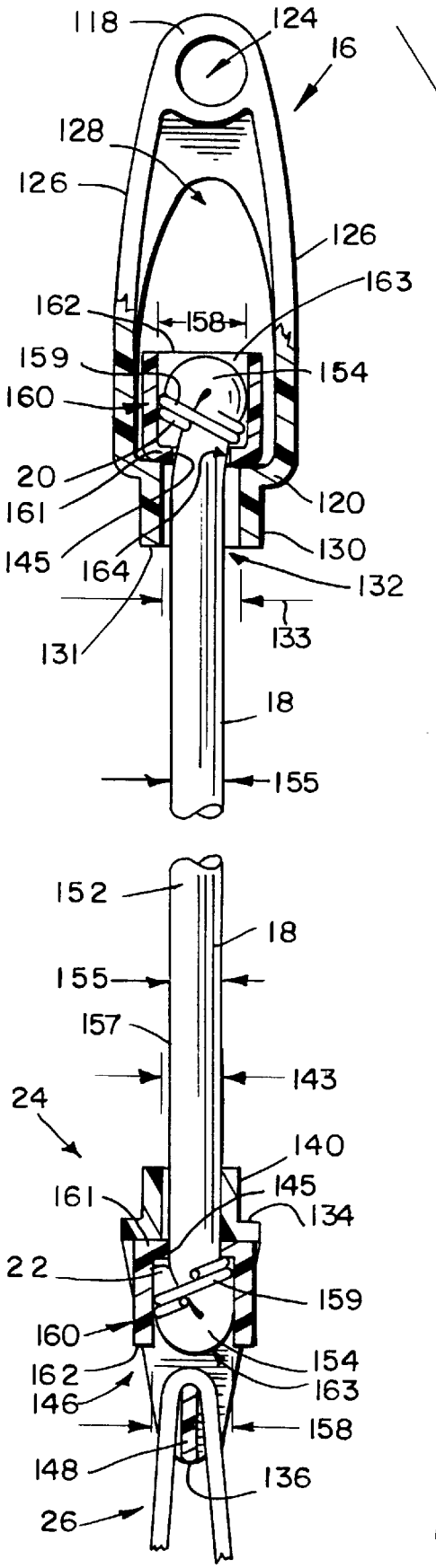
FIG. 3 is a cross-sectional view of the cord hanger, the belt hanger, and the extensible cord extending therebetween, and showing the extensible cord having a first end extending through the housing and forming a first bulb and a second end extending through the cord passageway and forming a second bulb such that the belt hanger is suspended from the cord hanger.

As shown in FIG. 2, the shock cord 18 includes opposite ends 20, 22 and an extensible center portion 152 extending between the cord hanger 16 and the belt hanger 24. Referring now to FIG. 3, one end 20 of the cord 18 is fastened within the cavity 128 of the cord hanger 16 and the opposite end 22 is fastened within the hollow space 146 of the belt hanger 24. The opposite ends 20, 22 are each folded back upon the center portion 152 to form a bulb 154 at each end 20, 22. Clamping means 156 are preferably positioned at each of the distal ends 20, 22 of the cord 18 so as to securely attach the ends 20, 22 to the center portion 152. Preferably, the cord 18 is an extensible shock cord having a substantially rubber-formed core (not shown) and a fabric cover 157 surrounding the core.

Figure 4:
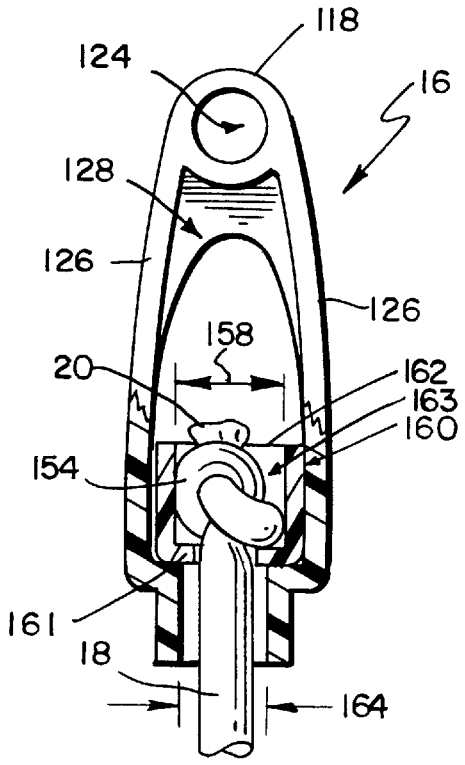
FIG. 4 is a cross-sectional view of an alternative embodiment of the present invention showing the first end of the extensible cord being formed in a knot.

Illustratively, the clamping means 156 at the opposite ends 20, 22 of the cord 18 is an end clip 159. The end clip 159 is generally a commercially available "hog" clip. However, it is understood that the end 20 could be knotted, as shown for example in FIG. 4, or glued to form the bulb 154. Other clamping apparatus which hold the cord 18 as the bulb 154 without tearing the fabric cover 157 during vertical bouncing of the seat 36 causing stretch of 100% of the cord 18 and which prevents the ends 20, 22 of the cord 18 from sliding through the respective passageways 132, 142 could be used in accordance with the present invention. As used throughout the specification the term cycles refers to stretching as shown by arrow 260 and rebounding as shown by arrow 258 of the cord 18 as shown in for example FIG. 7.

Continuing to refer to FIG. 3, the clamping means 156 further includes a end cap 160. The end cap 160 is generally cylindrical in shape and has one end 161 sized for engagement with the bottom end portion 120 of the cord hanger 16 and the head portion 134 of the belt hanger 24 respectively. Moreover, the end cap 160 includes a rim 145 having a diameter 155 defining a cord passageway 164 therethrough. The end cap 160 includes an opposite end 162 and a cord chamber 163 positioned between the ends 161, 162. The cord passageway 164 of the diameter 155 is less than the diameter 158 of the bulbs 154 positioned in the cord chamber 163 and extends through the end 161 as shown in, for example FIG. 3. Each bulb 154 has a diameter 158 that is greater than the diameter 155 of the respective rim 145 of the end cap 160. The end clip 159 that surrounds the bulbs 154 rests within the cord chamber 163. Therefore, in operation, the hog clip is coupled to the opposite ends 20, 22 of the cord 18 and is positioned within the chamber 163 of the end cap 160 to prevent the bulb 154 from sliding through the cord passageway 164 and thus cylindrical housing 130 and the casing 140 respectively.

Referring again to FIG. 2, the flexible belt 26 includes opposite ends 165, 166 and is sized for draping over the slat 148 in the belt hanger 24 and for weaving extension through the belt adjustor 28 to obtain the desired length of the belt 26. The belt adjustor 28 includes opposite sides 167 and three bars 168, 169, 170 extending between the opposite sides 167 to form two orifices 172, 174 therebetween. Referring now to FIG. 1, a first end 165 of the flexible belt 26 extends about the first bar 168 of the belt adjustor 28, through orifice 172, and upwardly toward the belt hanger 24. The first distal end 165 is folded upon itself and secured by stitching (not shown) to prevent the first distal end 165 of the flexible belt 26 from passing through orifice 172. Thus, the belt 26 extends upwardly away from the belt adjustor 28, passes through the belt hanger 24 over the slat 148, downwardly and back through the orifice 172. As shown in FIG. 2 by arrow 176, the flexible belt 26 then extends about the second bar 169, through orifice 174, and downwardly and away from the third bar 170 and toward the belt mount 30 as shown by arrow 178.

Referring now to FIG. 5, the belt mount 30 includes a slit 180 therethrough. The end 166 of belt 26 passes through the slit 180 and upwardly toward the belt adjuster 28. The distal end 166 is folded upon itself and secured by stitching 182. This stitching 182 prevents the distal end 166 of the belt 26 from passing through slit 180. With this arrangement, the length of belt 26 above the umbrella-shaped strap support 34 can be adjusted.

Referring now to FIG. 1, the strap support 34 includes a top portion 32 and an opposite underside 38 which holds the three flexible straps 40, 42, 44 in spaced-apart relation to one another. The strap support 34 includes three guide portions 184, 186, 188 extending from its underside 38 toward the seat 36. While only guide portions 184, 186 and straps 40, 42 are illustrated in FIG. 5 and hereafter discussed, it is understood that guide portion 188 and strap 44 are formed similarly.

As best shown in FIG. 3, the guide portions 184, 186 include a rim 190 defining a strap passageway 192 between the top portion 32 and the underside 38 of the strap support 34. In addition, locking portions 194 each corresponding with one guide portion 184, 186 have a lip 196 defining a strap extension route 198 between the underside 38 and top portion 32 of the strap support 34. Thus, the flexible straps 40, 42 extend upwardly from the seat 36, through the strap passageways 192 of the guide portions 184, 186 across the top portion 32, and downwardly through the strap extension route 198 of the locking portions 194 back toward the seat 36. Preferably, as shown in FIGS. 1 and 5, the top portion 32 of the strap support 34 is formed to include indented channels 200, 202, 204 extending between the respective guide portions 184, 186, 188 and the locking portions 194. The indented channels 200, 202, 204 permit the manufacturer to enhance the appearance of the exerciser apparatus 10 by draping the straps 40, 42, 44 through the channels 200, 202, 204 so that the straps 40, 42, 44 lie flush with the top portion 32 of the strap support 34.

As shown in FIG. 1, the seat 36 has a frame 206 that is generally circular in shape and includes an outward side 218, an inward side 220, and an outer edge 221 extending about the periphery of the frame 206. Moreover, the frame 206 includes an aperture 208 extending between the outward and inward sides 218, 220 of the frame 206. Preferably, the aperture 208 is sized to receive a child therein. In addition, the frame 206 includes a front side 230, an opposite a back side 232, and a back support portion 227 positioned on the back side 232. Illustratively, a bumper 229 preferably extends along the outer edge 221 about the periphery of the frame 206.

The seat 36 preferably includes a fabric seat 210 having a border portion 212 and an interior portion 214. As shown in FIGS. 1 and 3, the border portion 212 is preferably coupled to the inward side 220 of the frame 206 using any one of a wide variety of known coupling methods for fabric seats 210. For example, as shown in FIG. 6, the border 212 may include fabric tabs 215 and the frame 206 of the seat 36 may be formed to include clips 216 on the inward side 220. The clips 216 are formed to couple the fabric tabs 215 so that the border portion 212 is held to the seat 36. In addition, the interior portion 214 of the fabric seat 210 is formed to include holes 217 therethrough which are sized and positioned to receive legs of the child (not shown). As shown for example, in FIG. 1, the interior portion 214 of the fabric seat 210 is preferably positioned so that the holes 217 are positioned in spaced-apart relation to one another and face the front side 230 of the frame 206 of the seat 36.

The frame 206 of the seat 36 further includes three strap leaders 222, 224, 226 defining strap-receiving apertures 228 which extend between the outward and inward sides 218, 220. The strap leaders 222, 224, 226 are positioned in spaced-apart relation to one another about the frame 206 of the seat 36. As best shown in FIG. 5, the strap leader 224 is positioned on the back side 232 of the frame 206. The strap leader 224 extends from the inward side 220 away from the strap support 34. The strap 40 extends through the strap-receiving aperture 228 of the strap leader 224 and is coupled to the seat 36 adjacent the inward side 220. Moreover, as best shown in FIG. 1, two similarly formed strap leaders 222, 226 are positioned on the front side 230 of the frame 206 and extend upwardly toward the strap support 34. It is understood that although only strap leader 222 and strap 42 are illustrated in FIG. 6 and hereafter discussed, the leader 226 and strap 44 are formed similarly.

As shown in FIGS. 5–6, the flexible straps 40, 42 include opposite ends 234, 236 formed for extension through the strap leaders 222, 224 of the seat 36 and the guide portions 184, 186 of the strap support 34 respectively and a middle portion 237 extending therebetween. The opposite ends 234, 236 are each folded back upon the middle portion 237 to form a bulb 244 at each end 234, 236. Illustratively, strap clamping means 238 are preferably positioned at each of the distal ends 234, 236 of the straps 40, 42 so as to securely attach each of the ends 234, 236 to the middle portion 237. This attachment causes each bulb 244 at the end 234 to have a diameter 245 greater than the diameter 247 of the locking portions 194. Preferably, the straps 40, 42 are constructed of a non-extensible fabric.

Illustratively, the clamping means 238 at the opposite ends 234, 236 of the straps 40, 42 is a strap end clip 240. The strap end clip 240 is generally a commercially available "hog" clip. However, it is understood that the ends 234, 236 could be knotted or glued to form the bulb 244 that has the diameter 245 greater that of the locking portions 194. In addition, other clamping apparatus which hold the straps 40, 42 as the bulb 244 and which prevent the ends 234, 236 of the straps 40, 42 from sliding through the respective locking portions 194 and strap leaders 222, 224 could be used in accordance with the present invention.

Continuing to refer to FIGS. 5 and 6, the clamping means 238 further includes a retaining ring 242 at the end 236 of the straps 40, 42. The retaining ring 242 is generally cylindrical in shape and has an opening 246 sized for extension of the middle portion 237 of the straps 40, 42 therethrough. The retaining ring 242 has an end 248 that is sized for partial extension into the strap-receiving aperture 228 of the strap leaders 222, 224 and an opposite end 250. A flange 252 extends outwardly from the end 250 for engagement with the strap leaders 222, 224.

As best shown in FIGS. 5 and 6, the strap end clips 240 are preferably positioned over each of the bulbs 244 at the second distal end 234 to secure the strap 40, 42 to the underside 38 of the strap support 34. In that manner, the flexible straps 40, 42 securely support the seat 36 so that as the mounting assembly 14 is attached to the framework 12 of a doorway 46, the child placed within the seat 36 is suspended such that the feet of the child just touch a floor (not shown).

Figure 7:
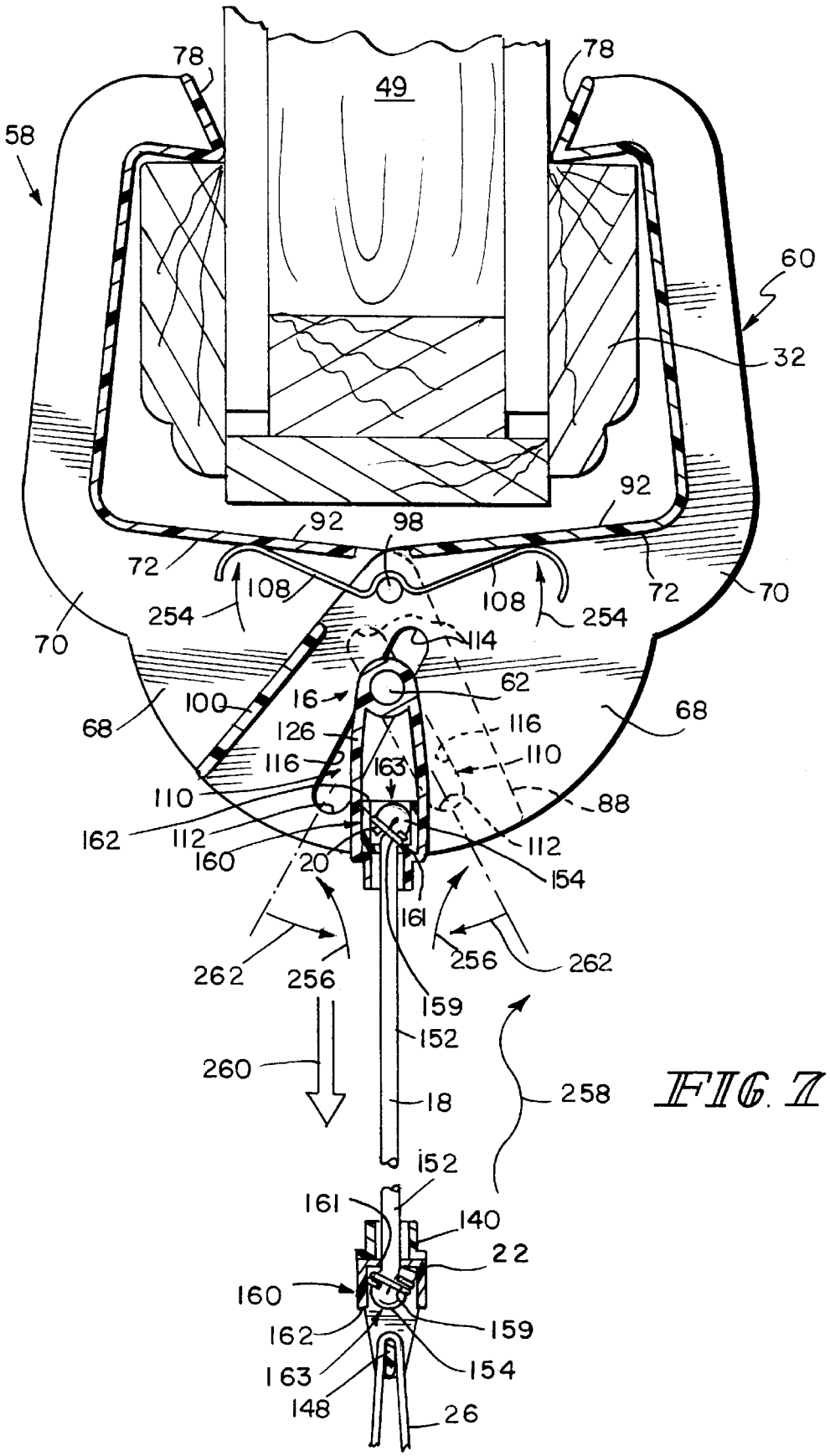
FIG. 7 is an assembled side view of the attachment mechanism of FIG. 2 in its fixed position about the framework of a doorway, showing the mounting assembly including a first clamp member having catch and a core with a slot (in phantom) therethrough and an opposing second clamp member having a catch and a core scissor mounted by a clamp pin to the core (in phantom), of the first clamp member, and showing the clamp pin biased in a wedged locked position.

To assemble the mounting assembly of the exerciser apparatus 10 in accordance with the present invention, the manufacturer extends the outer edges 88 of the second clamp member 60 between the first and second side walls 64, 66 of the first clamp member 58, as shown in, for example in FIG. 7. The arms 108 of the spring 104 extend as shown by arrows 253, shown in FIG. 2, between outer edges 88 of clamp member 58 and through the spring entrance 102 of clamp member 60. Referring again to FIG. 7, the spring 104 rests upon the rivet 98 and normally presses, as shown by arrows 254 against the inside faces 72 of the top platform 92. This pressure normally urges the catches 70 toward one another and the lower ends 112 of the slots 110 away from one another as shown by arrows 256.

Next, the top end portion 118 of the cord hanger 16 extends past the curved edges 90 and into the cores 68 of the first and second clamp members 58, 60. The clamp pin 62 extends through each of the slots 110 and through the aperture 124 extending through the top end portion 118 of the cord hanger 16. The cord hanger 16 is thus pivotably mounted on clamp pin 62.

Therefore, once assembled, a caregiver may easily attach the exerciser apparatus 10 onto the framework 12 of the doorway 46. As best shown in FIG. 7, the upper tabs 78 of the catches 70 are urged into engagement with the top portion 32 of the framework 12 and the structural wall 49. At that time, the cores 68 pivot away from one another so that the lower ends 112 of the slots 110 of the first and second clamp members 58, 60 diverge from one another to an extent dependent upon the width of the framework 12.

Once the mounting assembly 14 is securely fastened onto the framework 12, the child (not shown) may be placed within the seat 36. The weight of the child (not shown) results in downward pressure on the seat 36 which causes extension, as illustrated by arrow 260 of the extensible cord 18 and pressure on the clamp pin 62 of the mounting assembly 14. When the clamp pin 62 is pulled in the direction of arrow 260, it becomes wedged within the wedge portion 116 of the slots 110. Thus, the cord hanger 16 is prevented from sliding away from the framework 12 and toward the floor (not shown).

Once the child has been removed from the seat 36, the catches 70 may be yieldably biased away from the framework 12. This movement causes the lower ends 112 of the slots 110 to converge toward one another as shown by arrow. The slots 110 are able to move as shown by arrow 262 until the outer side platform 100 of the second clamp member 60 engages one border wall 126 of the cord hanger 16 and thus the slots 110 are in an alignment orientation.

Figure 8:
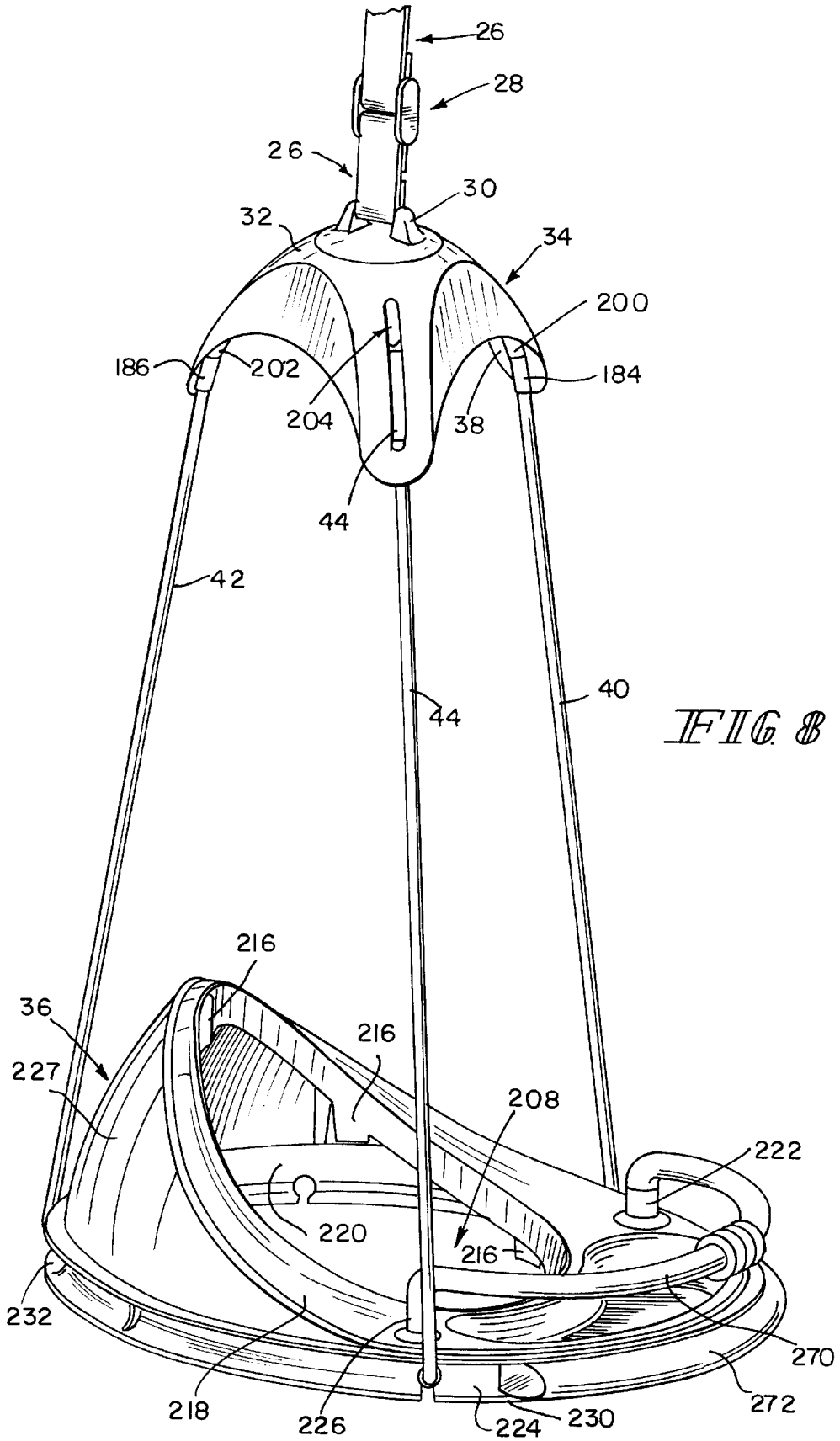
FIG. 8 is a perspective view of the seat portion of the exerciser apparatus showing the seat having a frame and an outer edge extending about the periphery of the frame, the outer edge including mounting slots therethrough and the flexible straps extending from the mounting slots towards the strap support.

In preferred embodiments of the present invention, the outer edge 221 that extends about the periphery of the frame 206 of the seat 36 is formed to include mounting slots 264 therethrough, as shown for example in FIG. 8. The straps 40, 42, 44 which are formed as previously described include the end 236 which extends through mounting slots 264. In this manner one end 248 of the retaining ring 242 extend through the mounting slots 264 and the flange 252 will securely engage the inward side 220 of the frame 206.

Figure 9:
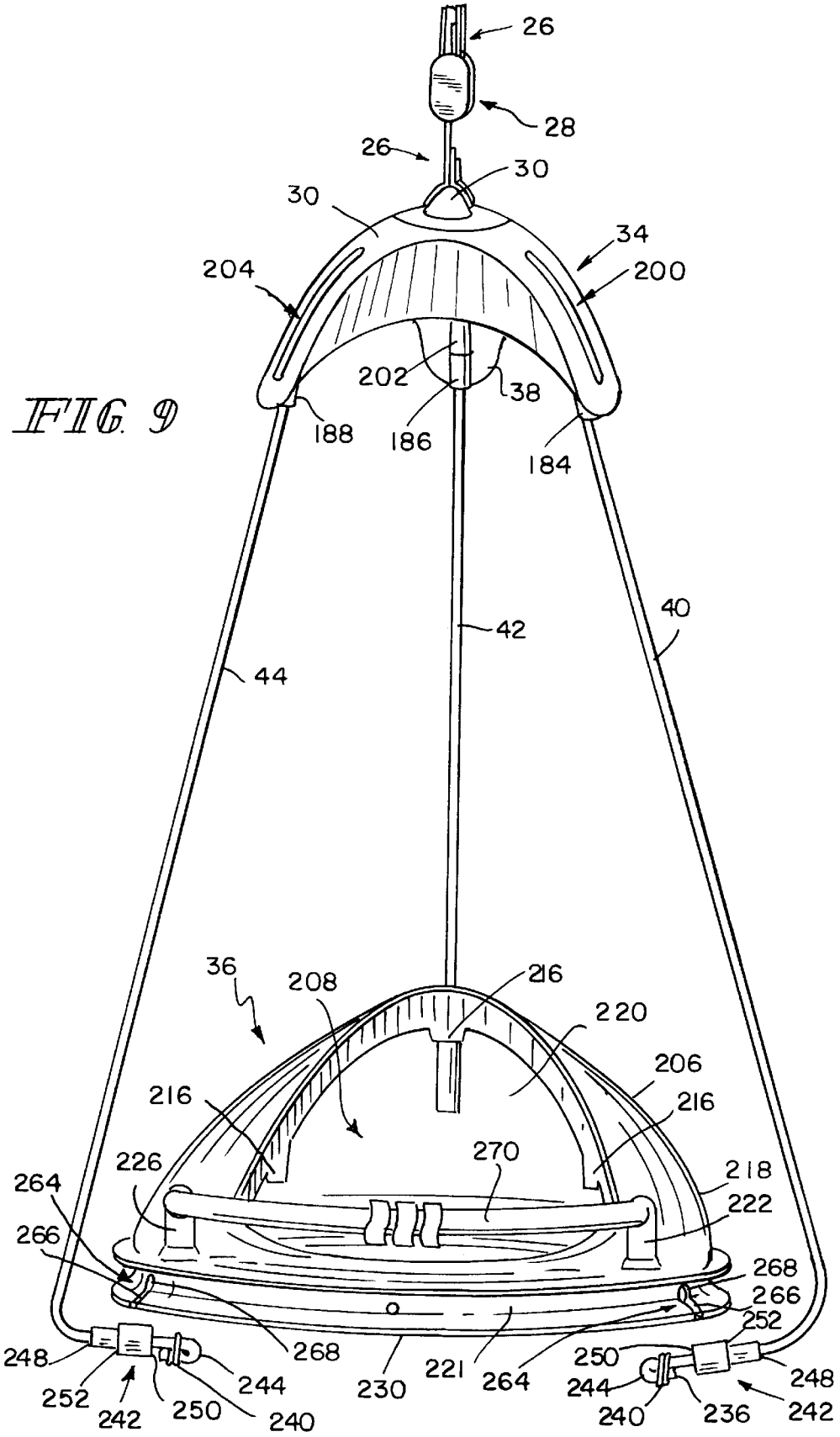
FIG. 9 is a perspective view of the frame of the seat including keyhole-shaped apertures extending therethrough.

In the preferred embodiments, the strap leaders 222, 226 are formed to support a cantilevered activity bar 270 therein. The activity bar extends outwardly from the first and second strap leaders 222, 226 at the front side 230 of the frame 206. In addition, as shown, for example, in FIG. 9, a bumper pad 272 extends along the outer edge 221 that extends about the periphery of the frame 206 of the seat 36 between the straps 40, 44.

In another preferred embodiment of the present invention, the mounting slots 264 are each formed as a keyhole to allow selective detachment of the seat 36 from the strap support 34. Once detached, the seat 36 may be mounted on a different apparatus. One such apparatus is described in detail in the patent application entitled "Stationary Baby Jumper-"filed simultaneously herewith on Nov. 10, 1995, the disclosure of which is expressly incorporated herein by reference.

Each keyhole-shaped mounting slot 264 includes a inserting passageway 266 having a width sized to receive the straps 40, 42, 44 but too narrow to receive the retaining ring 242 therein. The keyhole does however include a ring passageway 268 that is sized to receive the end 248 of the retaining ring 242, but not the flange 252. Thus, in order selectively mount and detach the straps 40, 42, 44 from the seat 36, the caregiver must simply grasp the end 236 of one of each of the extensible straps 40, 42, 44 and extend it through the inserting passageway 266 of the keyhole-shaped mounting slots 264. The straps 40, 42, 44 may then be released so that one end 248 of the retaining ring 242 will extend through the ring passageway 268 and the flange 252 will securely engage the inward side 220 of the frame 206.

Figure 10:
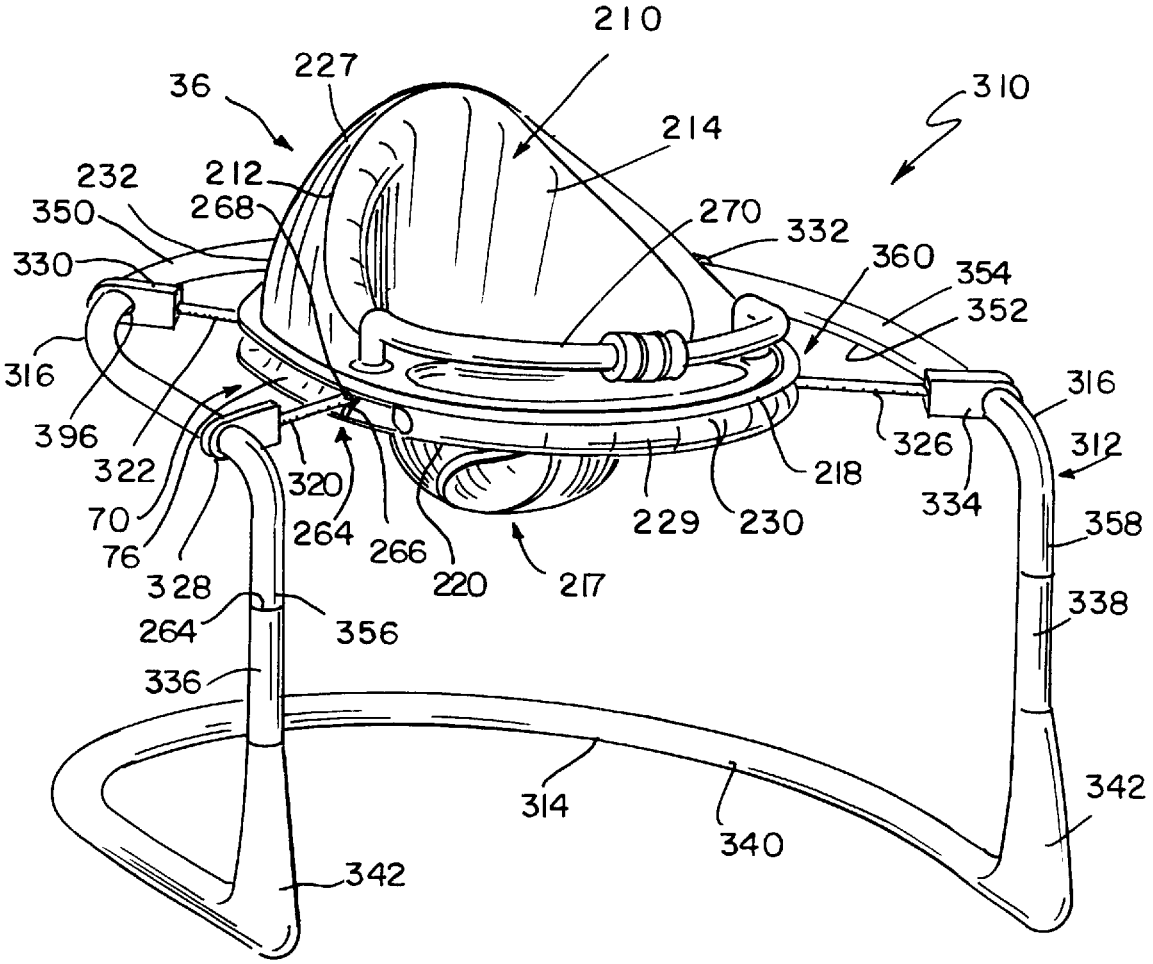
FIG. 10 is a perspective view of a stationary baby jumper having base leg, a cantilevered seat-support leg mounted on the base leg, a chair seat which includes a frame and a seating portion situated within the frame, connectors positioned in spaced-apart relation about the seat-support leg, and extensible cords extending between each of the connectors and the frame of the chair seat.

The straps 40, 42, 44 may be selectively removed from the keyhole-shaped mounting slots 264 and the seat 36 may be mounted on a stationary baby jumper apparatus 310 in accordance with the kit of the present invention, as shown for example in FIG. 10. The baby jumper apparatus remains in a substantially stationary position on the surface making it easy for a caregiver to use. The user will receive a kit including the mounting assembly 14, cord hanger 16, belt hanger 24, strap support 34, seat 36, a support frame 312, and shock cords of the type shown in FIG. 1 and 10. The user can attached seat 36 to the strap support 34 to provide a doorway exerciser or jumper. Alternatively, the user can connect seat 36 to support frame 312 to provide a stationary bouncer.

The jumper apparatus 310 includes a support frame 312 having a base leg 314 and a cantilevered seat-support leg 316 mounted upon and elevated above the base leg 314. Illustratively, the seat 36 is suspended from the seat-support leg 316 above the base leg 314 by extensible shock cords 320, 322, 326 which extend from the seat 36 to connectors 328, 330, 332, 334 positioned about the seat-support leg 316. Although three cords 320, 324, 328 are shown, it is understood that preferably four cords extend between the chair 36 and the respective connectors 328, 330, 332, 334.

The support frame 312 is formed for secure stationary positioning upon the surface. The base leg 314 of the support frame 312 includes a head portion 336, an opposite foot portion 338, and a shaft 340 interconnecting the head and foot portions 336, 338. Preferably, stabilizers 342 are affixed to both the head and the foot portions 336, 338. The head portion 336 is positioned in a spaced-apart relationship relative to the foot portion 338. The seat-support leg 316 interconnects the head portion 336 and the foot portion 338 of the base leg 314.

The seat-support leg 316 as shown in FIG. 10 has a curved shaft portion 350 with a concave side 352 arranged to face the respective head and foot portions 336, 338 of the base leg 314 and an opposite convex side 354. The seat-support leg 316 includes opposite end portions 356, 358 and the curved shaft 340 portion extends between the opposite end portions 356, 358. The end portions 356, 358 are positioned in a spaced-apart relation to one another so that a seat-receiving space 360 is formed therebetween.

Illustratively, the four connectors 328, 330, 332, 334 are formed to mount the seat 36 adjacent the seat-support leg 316 as shown, for example, in FIG. 10. The connectors 328, 330, 332, 334 allow the caregiver to mount the seat 36 easily onto the seat-support leg 316 using the shock cords 320, 322, 326. The connectors 328, 330, 332, 334 are formed to include a sleeve portion 396. The curved shaft portion 350 of the seat-support leg 316 is formed for extension through the sleeve portion 396, in order to mount the connector 328, 330, 332, 334 on the seat-support leg 316.

To assemble the jumper apparatus 310, the caregiver simply inserts the end portions 356, 358 into the respective head and foot portions 336, 338 of the base leg 314. The caregiver then aligns the seat 36 so that the front side 230 of the frame 206 faces toward the end portions 356, 358 of the seat-support leg 316. At this time, each connector 328, 330, 332, 334 should be aligned with one of the keyhole-shaped mounting slots 264 formed through the outer edge 221 of the chair frame 206. Once the connectors 328, 330, 332, 334 and the keyhole-shaped mounting slots 264 are aligned, the caregiver must simply grasp the one of each of the extensible cords 320, 322, 326 and stretch it so that it extends through the aligning inserting passageway 266 of the keyhole-shaped mounting slots 264. The cords 320, 322, 326 may then be released so that the cords 320, 322, 326 securely engage the frame 70.

To use the exerciser apparatus 10, the caregiver must simply attach the upper tabs 78 on the framework 12. At this time, the height of the seat 36 is adjusted by the flexible belt 26 so that the feet (not shown) of the child will just touch the floor when the seat 36 is stationary. The caregiver then places the child through the aperture 208 in the frame 206 and into the fabric seat 210 portion so that the child faces the front side 230. By exerting intermittent downward pressure of the child's feet on the floor, the child may repeatedly bounce the seat 36 at a repetition rate having natural frequency (and period) determined, in part, by the weight of the child and, also in part, by the resiliency of the extensible cord 18.

Although the invention has been described in detail with reference to certain preferred embodiments, variations and modifications exist within the scope and spirit of the invention as described and defined in the following claims.

What is claimed is:

1. A doorway exerciser apparatus comprising a mounting assembly adapted for removable attachment with a doorway framework and formed to include a passageway therein, a lower hanger being formed to include a passageway therein, a shock cord having opposite ends find and an extensible center portion extending between the opposite ends, one end of the cord extending in the passageway of the mounting assembly and forming a first bulb, and an opposite second end of each cord extending in the passageway of the lower hanger and forming a second bulb so that the lower hanger is suspended from the mounting assembly, a seat unit suspended from the lower hanger, wherein the mounting assembly has a first clamp member including a catch and a core, an opposing second clamp member which includes a catch and a core, and the cores of the first and second clamp members are coupled together for pivotable movement therebetween, wherein the cores of the first and second clamp members are each formed to include a slot therethrough and the cores are positioned relative to one another such that the slots at least partially overlap one another, and wherein the mounting assembly is further formed to include a clamp pin extending through the slots.

2. The exerciser apparatus of claim 1, wherein the mounting assembly includes a cord hanger that is pivotally mounted on the clamp pin of the mounting assembly.

3. The exerciser apparatus of claim 1, wherein the slots are each formed to include an upper end, an opposite lower end, and a wedge portion positioned therebetween and the clamp pin is formed for slidable movement between the upper and the lower ends.

4. The exerciser apparatus of claim 1, wherein the clamp pin is securely fixed in the wedge portion of the slots when the mounting assembly is affixed on a framework and the extensible cord is urged in a direction away from the mounting assembly.

5. A doorway exerciser apparatus comprising a mounting assembly formed for removable attachment with a doorway framework, a cord hanger including a top end portion pivotally mounted within the mounting assembly and an opposite bottom end portion formed to include housing defining a passageway therethrough, a belt hanger including a head portion and an opposite tail portion formed to include a casing defining a cord passageway therethrough, an extensible cord having opposite ends, the first end of the cord projecting through the passageway within the bottom end portion of the cord hanger and forming a bulb having a size greater than the diameter of the housing, and an opposite second end of each cord extending through the cord passageway of the casing and forming a second bulb having a size greater than the diameter of the casing so that the belt hanger is suspended from the mounting assembly, a strap support being formed to include top portion, an underside, and a belt mount affixed to the top portion, a flexible belt being mounted for extension, between the tail portion of the belt hanger and the belt mount of the strap support, a seat, flexible straps being fastened to the seat and terminating at their distal ends in loop knots which are formed for secure engagement with the underside of the strap support and, wherein the mounting assembly has a first clamp member including a catch and a core an opposing second clamp member which includes a catch and a core and the cores of the first and second clamp members are coupled together for pivotable movement there between, wherein the cores of the first and second clamp members are each formed to include a slot therethrough and the cores are positioned relative to one another such that the slots at least partially overlap one another and wherein the mounting assembly is further formed to include a clamp pin extending through the slots.

6. The exerciser apparatus of claim 5, wherein the second end of the cord is folded upon the center portion to form a looped portion of the second bulb.

7. The exerciser apparatus of claim 6, wherein a clamp is positioned about the looped portion to fasten the second end against the center portion.

8. The exerciser apparatus of claim 5, wherein the first end of the cord is folded upon the center portion to form a looped portion of the first bulb.

9. The exerciser apparatus of claim 8, further comprising means for fastening the first end of the cord upon the center portion.

10. The apparatus of claim 5, wherein the flexible belt is adjustable.

11. A doorway exerciser apparatus comprising a mounting assembly formed for removable attachment with a doorway framework, a cord hanger including a top end portion pivotally mounted within the mounting assembly and an opposite bottom end portion formed to include housing defining a passageway therethrough, a belt hanger including a head portion and an opposite tail portion formed to include a casing defining a cord passageway therethrough, an extensible cord having opposite ends, the first end of the cord projecting through the passageway within the bottom end portion of the cord hanger and forming a bulb having a size greater than the diameter of the housing, and an opposite second end of each cord extending through the cord passageway of the casing and forming a second bulb having a size greater than the diameter of the casing so that the belt hanger is suspended from the mounting assembly, a strap support being formed to include top portion, an underside, and a belt mount affixed to the top portion, a flexible belt being mounted for extension between the tail portion of the belt hanger and the belt mount of the strap support, a seat including a frame having an outward side, an opposite inward side, and an outer edge extending between the outward and inward sides, the outer edge being formed to include a plurality of cord-mounting slots positioned in spaced-apart relation to one another, flexible straps being fastened to the seat and extending through the cord-mounting slots, the straps terminating at their distal ends in loop knots which are formed for secure engagement with the underside of the strap support and, wherein the mounting assembly has a first clamp member including a catch and a core an opposing second clamp member which includes a catch and a core and the cores of the first and second clamp members are coupled together for pivotable movement there between, wherein the cores of the first and second clamp members are each formed to include a slot there through and the cores are positioned relative to one another such that the slots at least partially overlap one another and wherein the mounting assembly is further formed to include a clamp pin extending through the slots.

12. The exerciser apparatus of claim 11, further comprising means for fastening the first and second ends of the cord to the center portion.

13. The exerciser apparatus of claim 12, wherein the fastening means includes an end clip extending about the bulb and an end cap.

14. The exerciser apparatus of claim 13, wherein the end cap includes opposite ends and a cord chamber positioned therebetween and the end cap is held within the cord chamber.

* * * * *